United States Patent [19]

Alves dos Santos et al.

[11] 4,315,695

[45] Feb. 16, 1982

[54] INERTIA PEN WITH SLIDABLE SLEEVE

[76] Inventors: Antonio M. Alves dos Santos; Helena Maria B. Alves dos Santos, both of Ferão Alvares do Oriente, 4-2° Dto., Lisbon, Portugal, 1700

[21] Appl. No.: 94,759

[22] Filed: Nov. 16, 1979

[30] Foreign Application Priority Data

Nov. 20, 1978 [PT] Portugal ..... 68804

[51] Int. Cl.[3] ..... B43K 23/00; B43K 27/00; B43K 24/00

[52] U.S. Cl. ..... 401/99; 401/29; 401/91; 401/107; 401/115; 401/117; 401/209; 401/274

[58] Field of Search ..... 401/115, 29, 117, 107, 401/99, 91, 274

[56] References Cited

U.S. PATENT DOCUMENTS

| | | | |
|---|---|---|---|
| 2,823,645 | 2/1958 | Johnson | 401/115 |
| 2,887,708 | 5/1959 | Kane | 401/117 |
| 3,602,600 | 8/1971 | Kanski | 401/115 |

FOREIGN PATENT DOCUMENTS

| | | | |
|---|---|---|---|
| 1092809 | 11/1960 | Fed. Rep. of Germany | 401/115 |
| 1131555 | 6/1962 | Fed. Rep. of Germany | 401/115 |
| 1424164 | 2/1976 | United Kingdom | 401/115 |

*Primary Examiner*—Steven A. Bratlie
*Attorney, Agent, or Firm*—Holman & Stern

[57] ABSTRACT

This invention relates to inertia pens, or writing or marking devices wherein a sleeve is shifted by axial impulse between a position exposing the writing tip and a position enclosing the writing tip. The kinetic energy of the impulse is transmitted to a calibrated mass slide within the pen which slide transfers its energy to the sleeve. A return spring is utilized and the pen may be simple, compound, binary or multifunctional. By obviating the push button or other manual actuator, writing or marking elements may be provided at both ends.

3 Claims, 27 Drawing Figures

FIG. 4
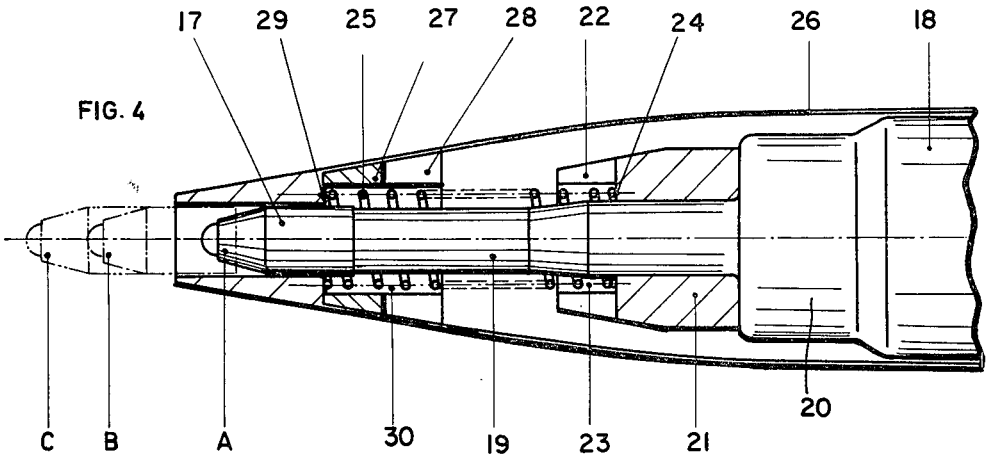
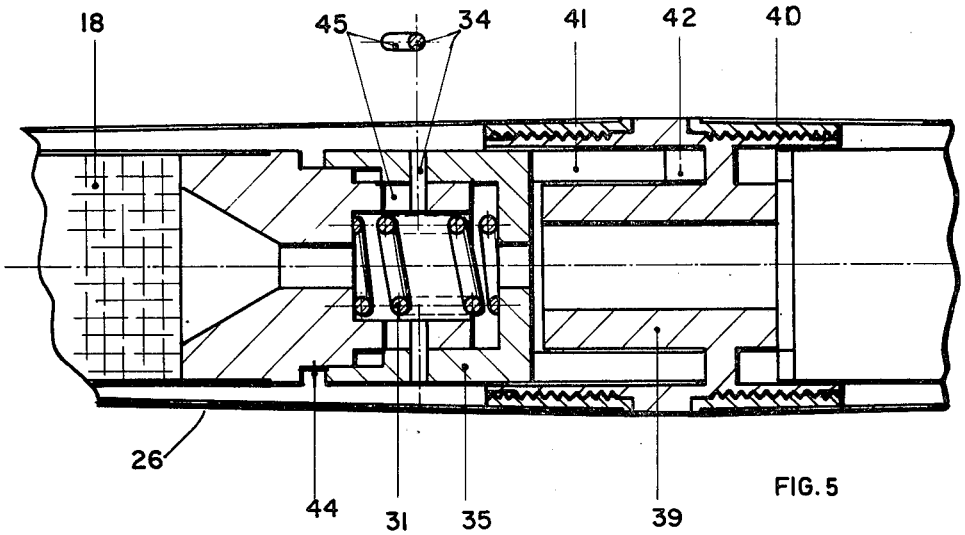
FIG. 5
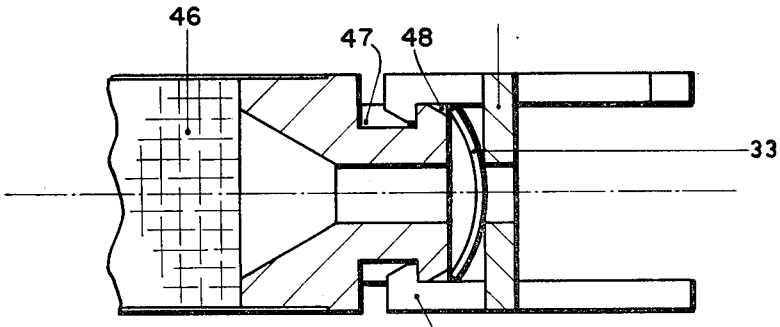
FIG. 6a
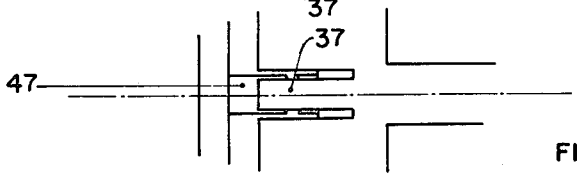
FIG.6b

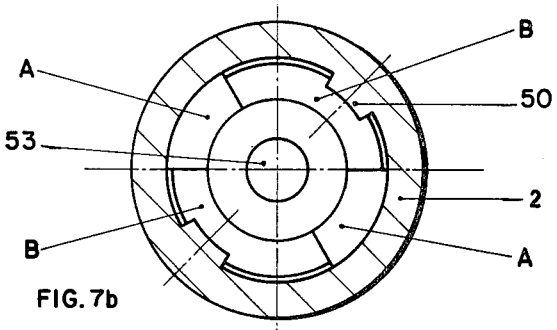
FIG. 7b
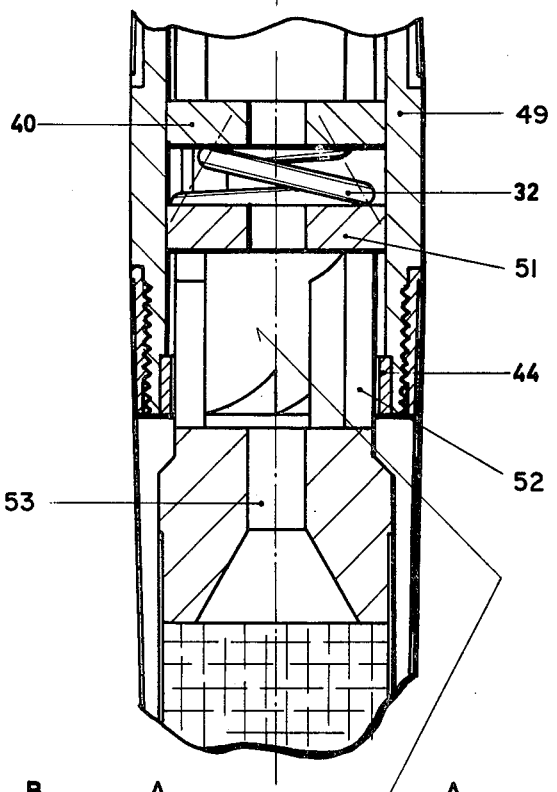
FIG. 7a
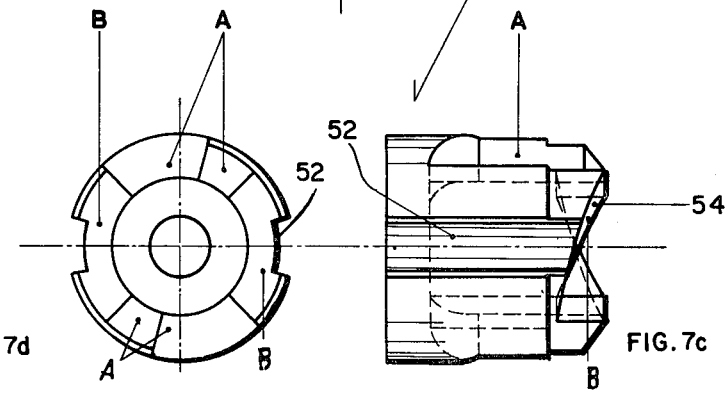
FIG. 7d
FIG. 7c

FIG. 8
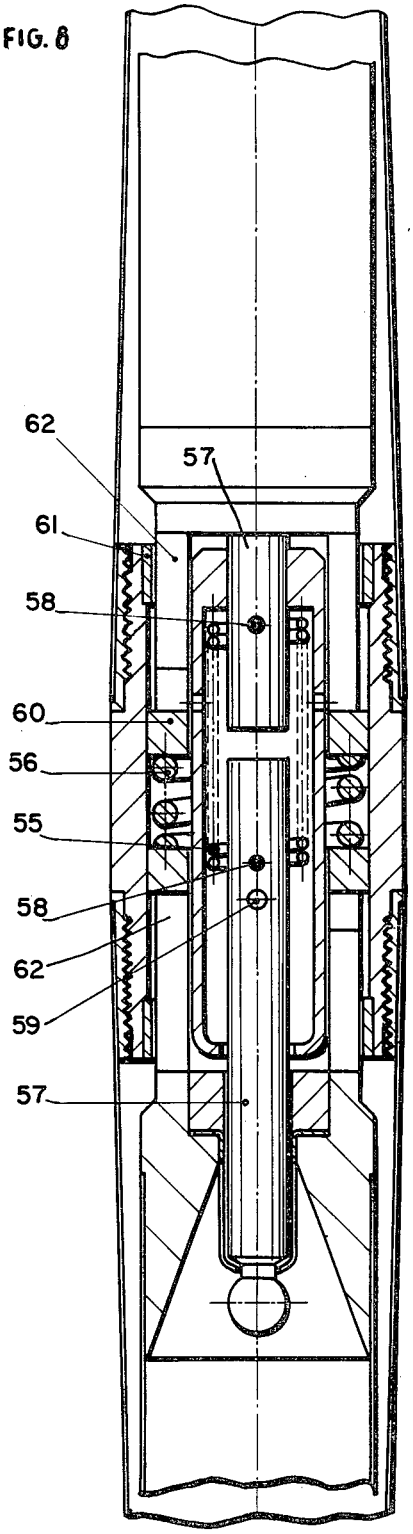
FIG. 9
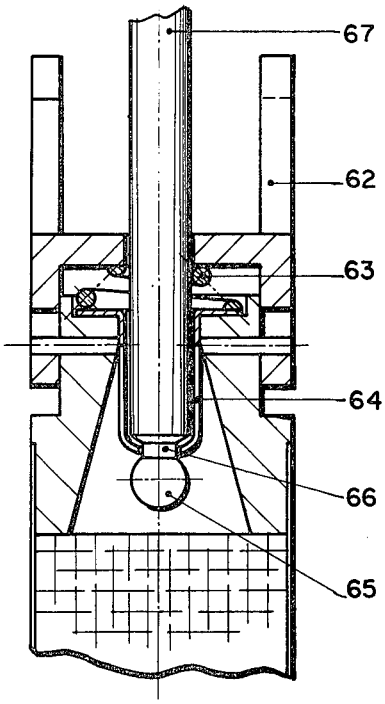
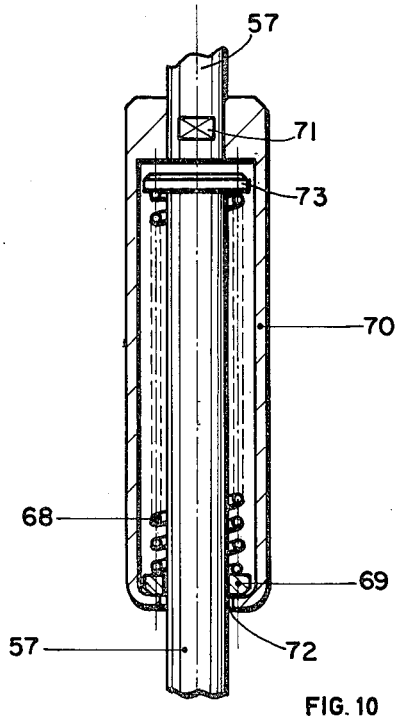
FIG. 10

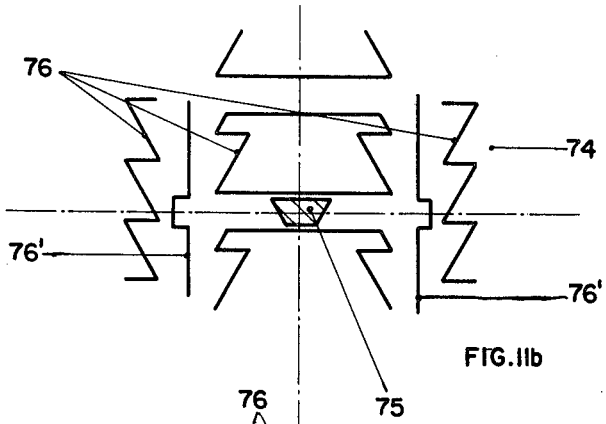
FIG. 11b
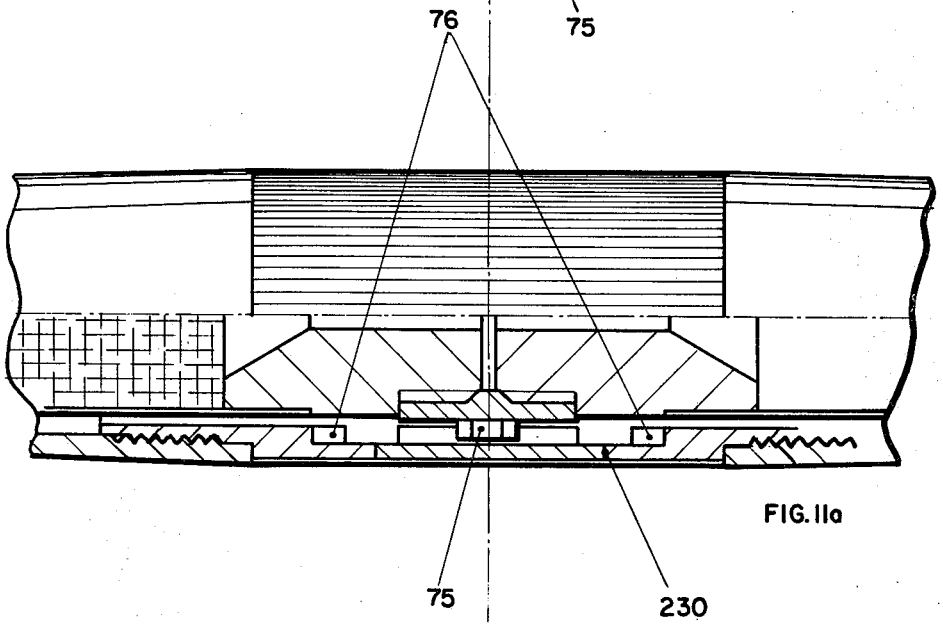
FIG. 11a
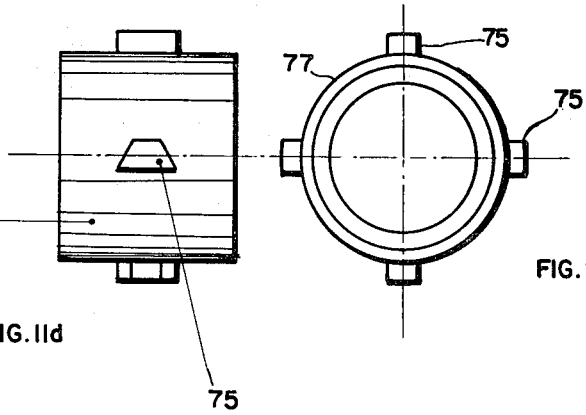
FIG. 11c
FIG. 11d

FIG. 17b
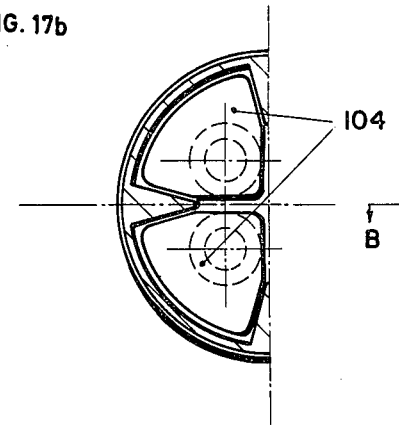
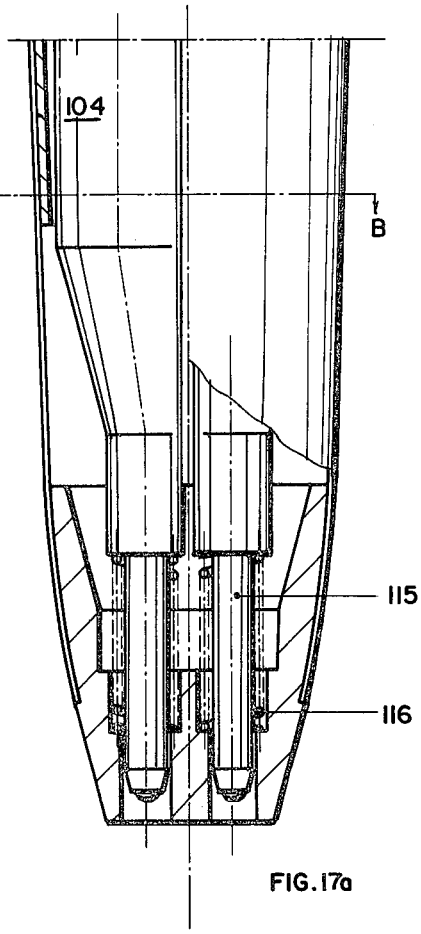
FIG. 17a
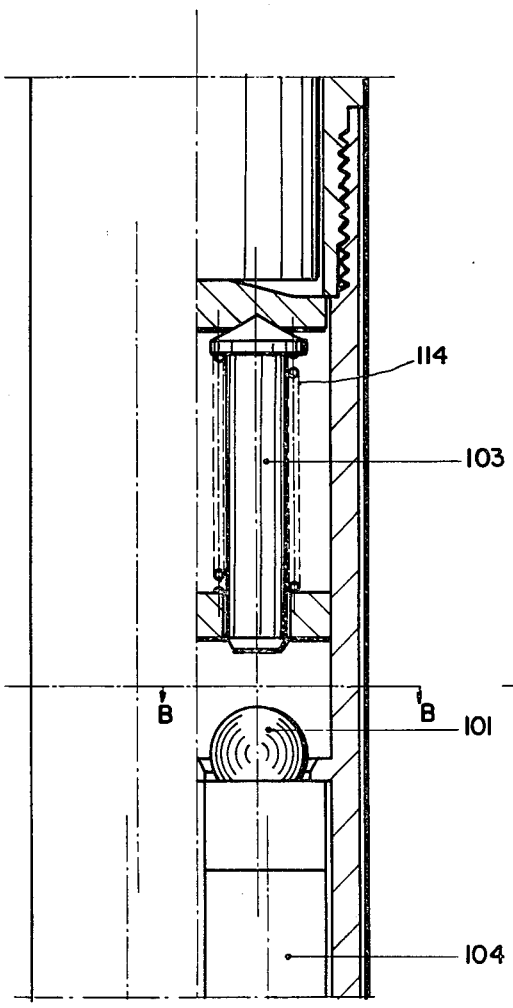
FIG. 18a
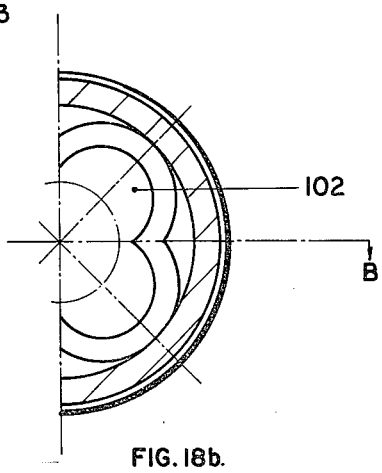
FIG. 18b.

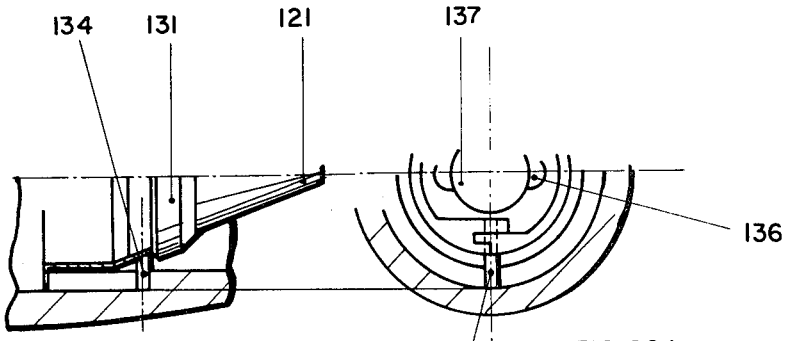
FIG.20c
FIG.20d
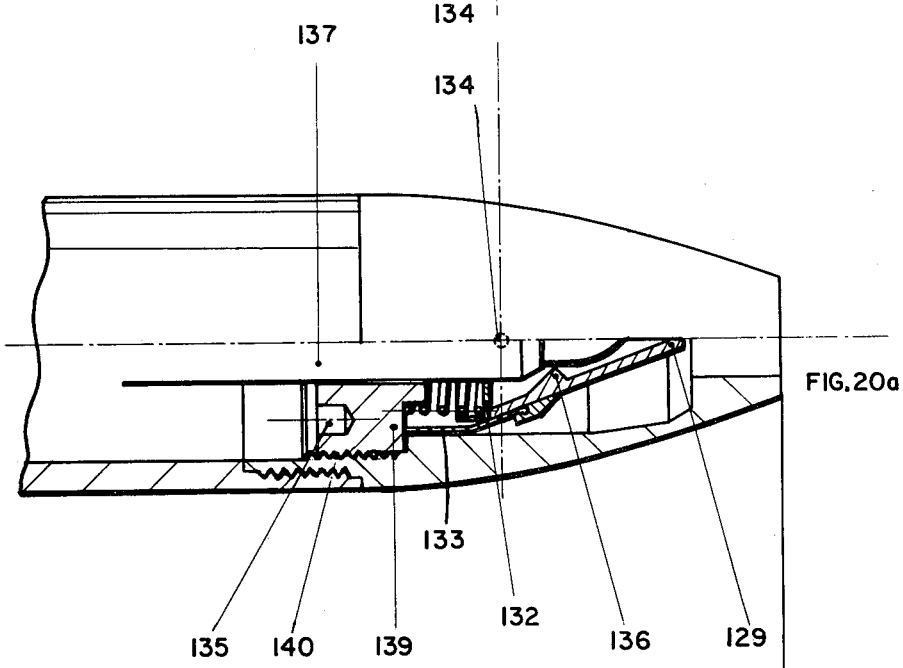
FIG.20a
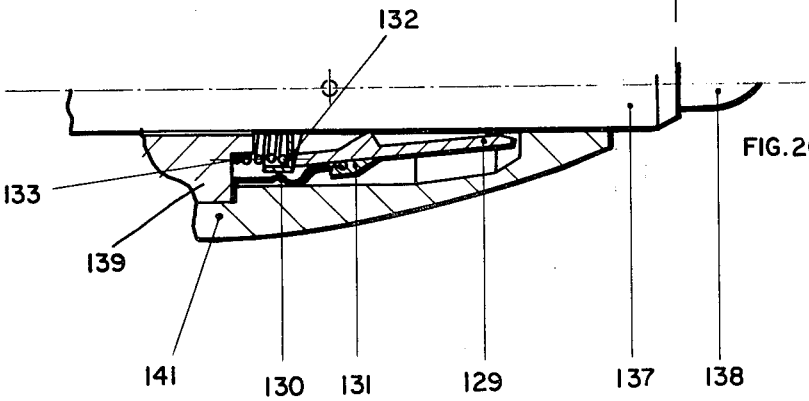
FIG.20b 158
143

159
143
143
A
144
153
B
142
148
20
147

149
155

152
145
150
151
143

146
154
48
157
146
156
153
156

93
155

160
142
155

173
173
168
171
113
169
167
163
113
172

162
162
166
165
164
164
A
161
161
161

B B 170
181
184
180
183
182
176
177
179
178
174
175
165
164
165'
164'

213
214
212

211

212
213
215

214
217
218
220
213
212

216

INERTIA PEN WITH SLIDABLE SLEEVE

BRIEF SUMMARY OF THE INVENTION

An objective analysis of present technologies and markets of pens and similar writing articles reveals, notwithstanding their high manufacturing quality, at least four technically favorable areas for industrial innovation and profitable economic exploitation.

The fountain pens, markers, felt or nylon pens, fixed ball-points and some other pens, which represent the greater part of the world product market, continue to be manufactured with moving caps, which are necessarily less interesting than the corresponding mechanical ones, which require no caps.

The practical possibility of combining the binary mechanisms of ball-points with those of pencils has not been adopted so far. There are even various types of pencils, such as carbon, wax and chalk ones, which do not profit by such combining of mechanisms.

Binary bipolar pens and inertia pens are not yet available in the market place, and, although the four points selecting pens do exist, their economic effect on the market is meaningless, which fact contrasts obviously with their potential interest.

An important effort is to be made to develop general use of binary pens and mechanisms with both writing and nonwriting points and for new technological fields, such as medico-chirurgic, pedagogic, industrial and others.

The inertia pen was conceived to answer the questions contained in the four areas of technology just mentioned. They have been approached from a rational and integrated point of view. Fundamental concepts such as inertia, bipolarity, multifunctionality and universality and actual methods and transfer mechanisms (or circuits), as interdisciplinary and technology transfer aspects, have been taken into consideration.

The inertia concept refers to the application of the inertia principle to the alternating mechanism, as it is currently available, i.e., provided with push, or rotating, button;

The bipolarity concept evolves directly from the inertia concept and consists of providing pens with inertia bipolar mechanisms, with or without conventional push or rotating buttons;

The concept of multifunctionality consists of complementing the main binary function (alternation) with accessory assemblies, thus considerably diversifying the existing writing means;

The universality concept means that the inertia pen applies indistinctively to writing and non-writing points, and consequently to new technological domains, such as medico-chirurgic, pedagogic, industrial and others, as previously stated.

The principal object of the present invention is a binary inertia mechanism, which works by the axial impulsion process, in which the kinetic energy transmitted to a slide of calibrated mass is subsequently transferred, by the inerita principle, to a recovering spring of calibrated force.

Another object of the inertia pen is an inertia bipolar mechanism in accordance with the main object of the invention, which mechanism insures the alternating function autonomously at each one of the poles.

Another object regards a feature of the inertia pen having one or both poles provided with an alternating mechanism, the slide of which is a tubular cylindrical sleeve. This sleeve is coaxial with the writing pen point. The point and its refill are fixed. The refill may be the component of the external pen body.

Another object is an alternating mechanism, in accordance with the previous object, in which the sliding sleeve of calibrated mass is replaced by a sliding point of calibrated mass.

Another object refers to binary mechanism, in accordance with the previous object, provided with optional buffer and/or tradition push button.

Another object regards the referred mechanism for two opposite refills axially coupled.

Another object of the inertia pen consists of an inertia mechanism provided with gravity points selector. This selector may be bipolar or operate multiple points. The points may be centered or eccentric.

Another object is the said mechanism provided with obturator (ball, cone or hemisphere) to isolate rapid drying ink points from external air (markers, felt or nylon points, fountain pens).

Another object regards the coexistence of pencil and ball-point binary mechanisms with each other and with the inertia ones, namely by the following accessory parts or assemblies: pencil slider, points gauge, collet, telescopic elongator (gravity oscillator bar or drum).

Another object is the inertia pen and mechanism provided with calibrated mass and univeral socket slider, for interchangeable writing or non-writing points.

Still another object of the invention refers to calibrated mass and universal socket points as such: simple or multiple, oblique (prominent or short), with buffer, with socket.

Another object regards the refills or depots, also mass calibrated and of universal socket: simple or multiple (multipliers), coupling or assembling, selecting (by gravity or by rotating button).

These various objects may in general coexist in a single embodiment of the inertia pen.

BRIEF DESCRIPTION OF THE SEVERAL VIEWS OF THE DRAWINGS

FIG. 4 is a cross-sectional view of the polar extremity of an inertia pen provided with an inertia mechanism of sliding refill and point.

FIG. 5 is a cross-sectional central part of FIG. 4 and shows that the binary mechanism is common to both poles and includes a point buffer.

FIGS. *6a* and *6b*, show in cross-section and partial bottom views a different type of point buffer.

FIGS. *7a*, *7b*, *7c* and *7d* show in cross-section and elevation views various details of the mechanism guiding system and a conic spring point buffer.

FIG. 8 is a cross-section of an inertia bipolar mechanism, with recovering traction spring, common to both poles, and buffer spring also common to both poles.

FIG. 9 shows a detail in cross-section of a part of FIG. 8, relative to the refill and slider coupling, and another embodiment of a buffer spring integrated into the polar refill.

FIG. 10 is another detail in cross-section of a part of FIG. 8, in which the recovering spring is a compression type, common to both poles.

FIG. 11*a* is a cut-away view partially in cross-section showing details of an inertia binary bipolar mechanism in which the two polar refills, axially coupled, constitute a bipolar single slider.

FIG. 11*b* shows a schematic layout of the guiding system of FIG. 11*a*.

FIG. 11*c* shows an elevation view of the drum compartment.

FIG. 11*d* shows a left side view of FIG. 11*c*.

Figure 12B:
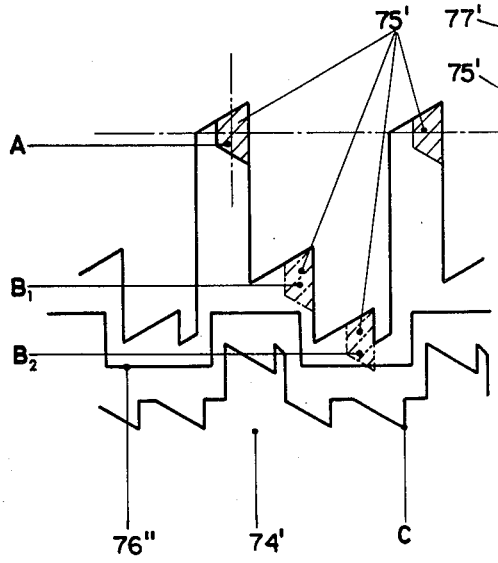
Figure 12A:
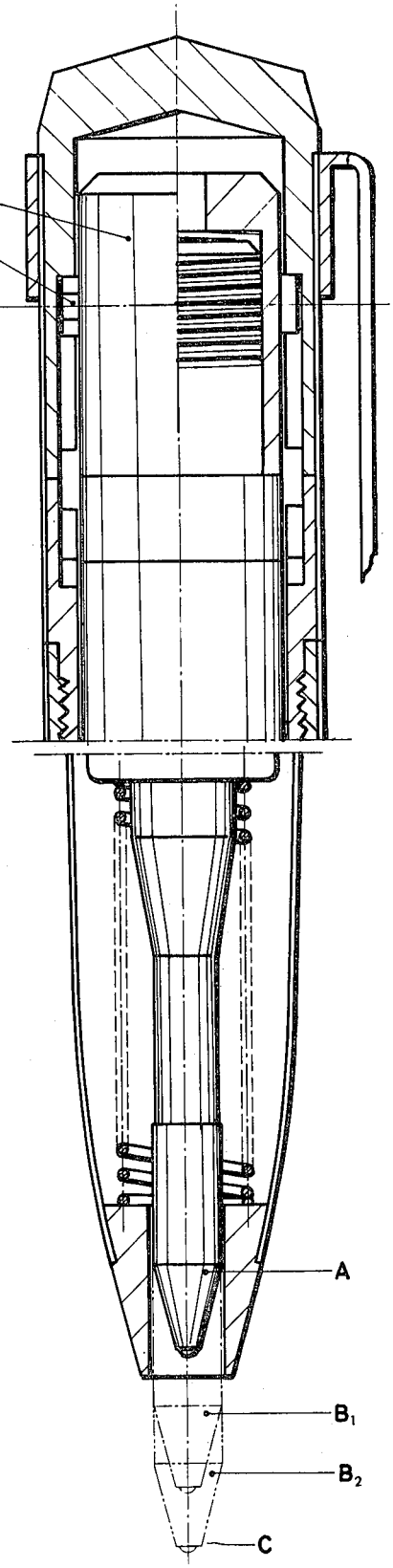

FIG. 12*a* shows in cross-section a monopolar inertia pen with optional push button and three level mechanism, where its guiding system provides two positions of use of the point-normal and for stencil- in an interative way.

FIG. 12*b* shows a schematic layout of the guiding system of FIG. 12*a*.

Figures 13A, 13B:
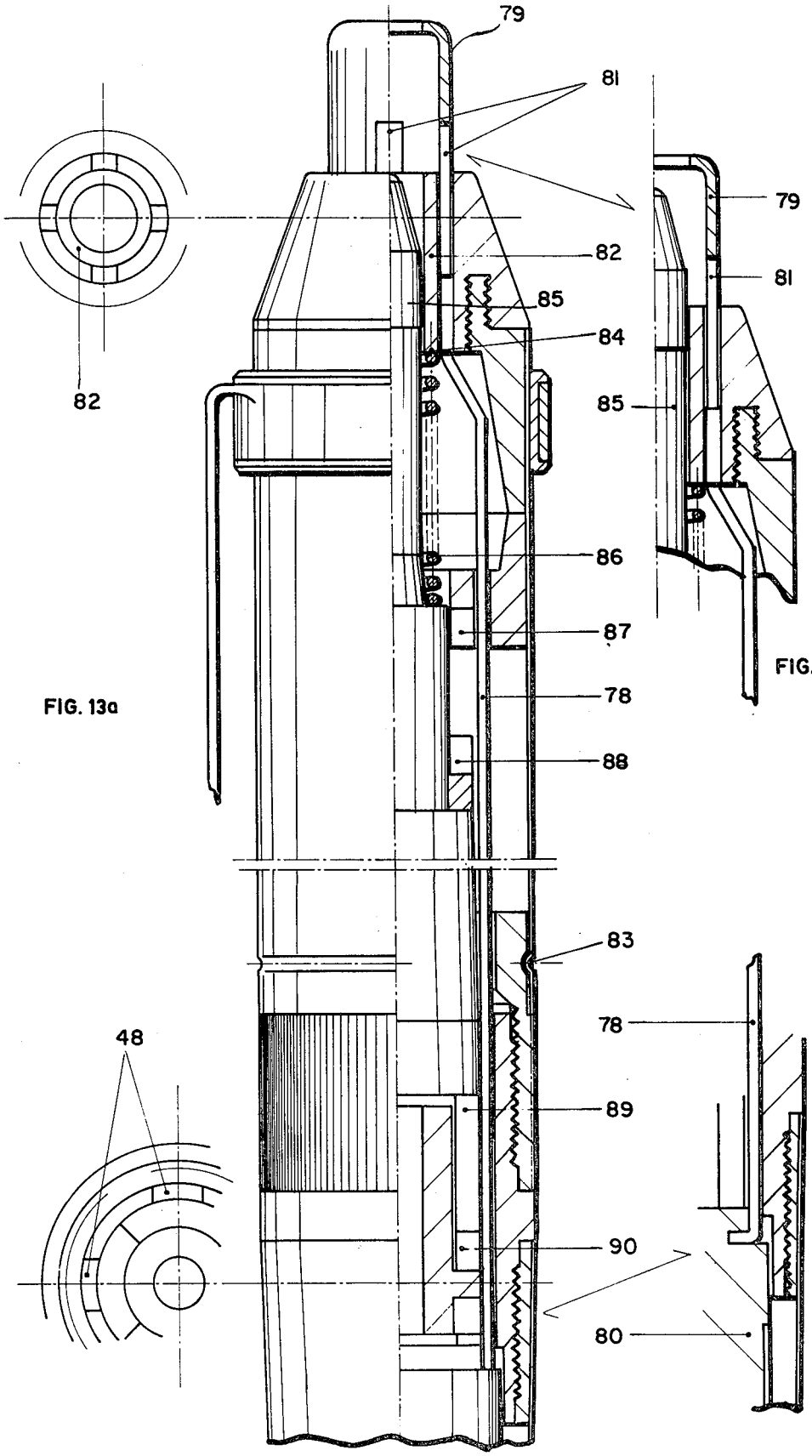

FIG. 13*a* is a cut-away view partially in cross-section showing a two pole inertia pen, having an optional press button at one pole, which button is attached to the other pole slide, by means of a convenient stem.

FIG. 13*b* is a partial cross-section showing of the embodiment of FIG. 13*a* showing certain parts in more detail.

Figure 14:
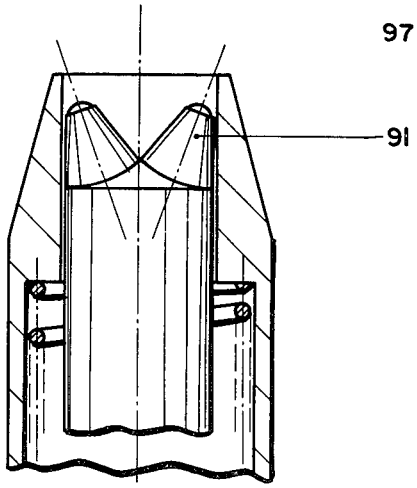

FIG. 14 is a view in cross-section showing a multiple point not exceeding the normal diameter of the slide column.

Figure 15C:
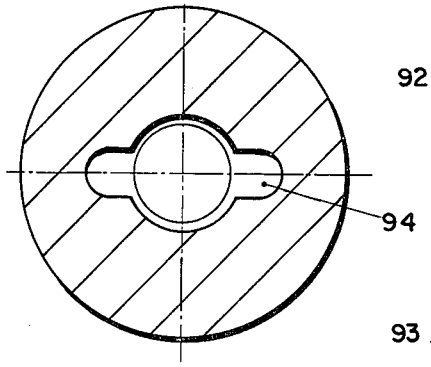
Figure 15B:
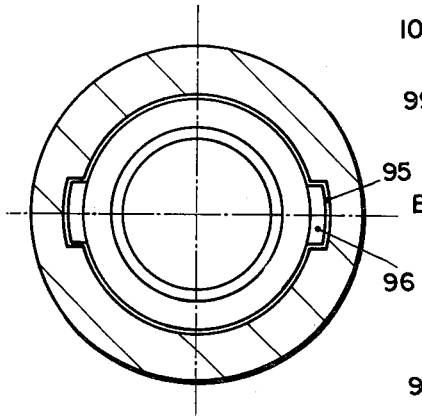
Figure 15A:
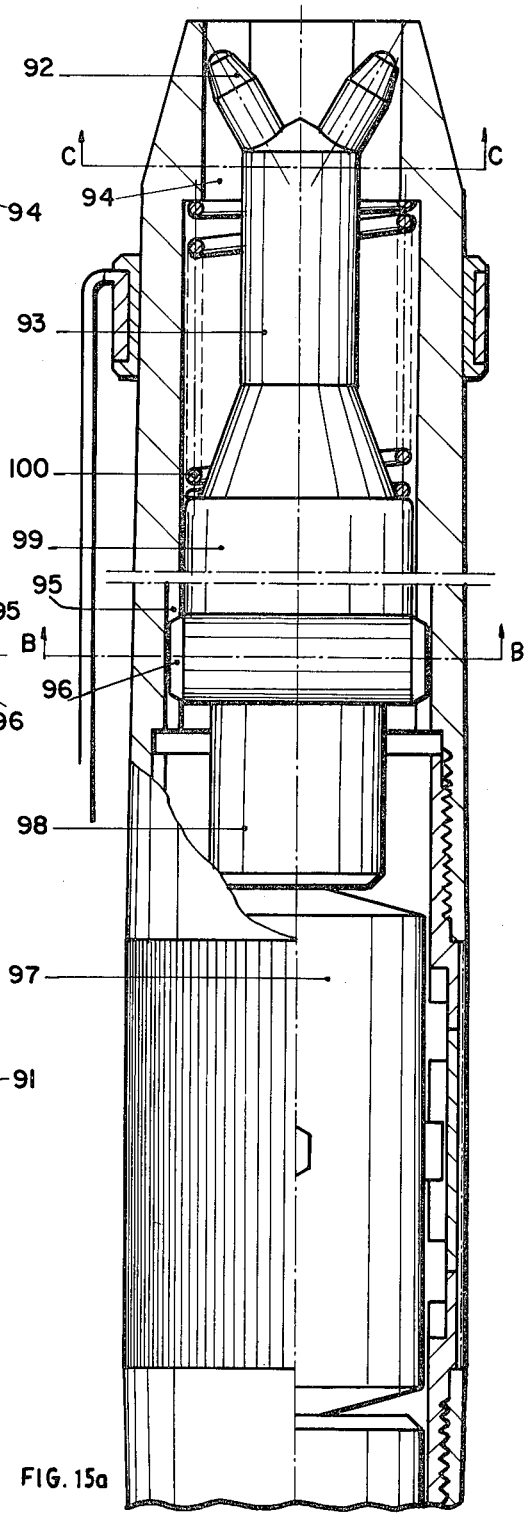

FIG. 15*a* is a cut-away view partially in cross-section showing a mechanism whose refill ball-point exceeds the diameter of the point stem and the refill is not rotative.

FIG. 15*b* is a cross-section along the line B—B of FIG. 15*a*.

FIG. 15*c* is a cross-section along the line C—C of FIG. 15*a*.

Figures 16A, 16B, 16C, 16D:
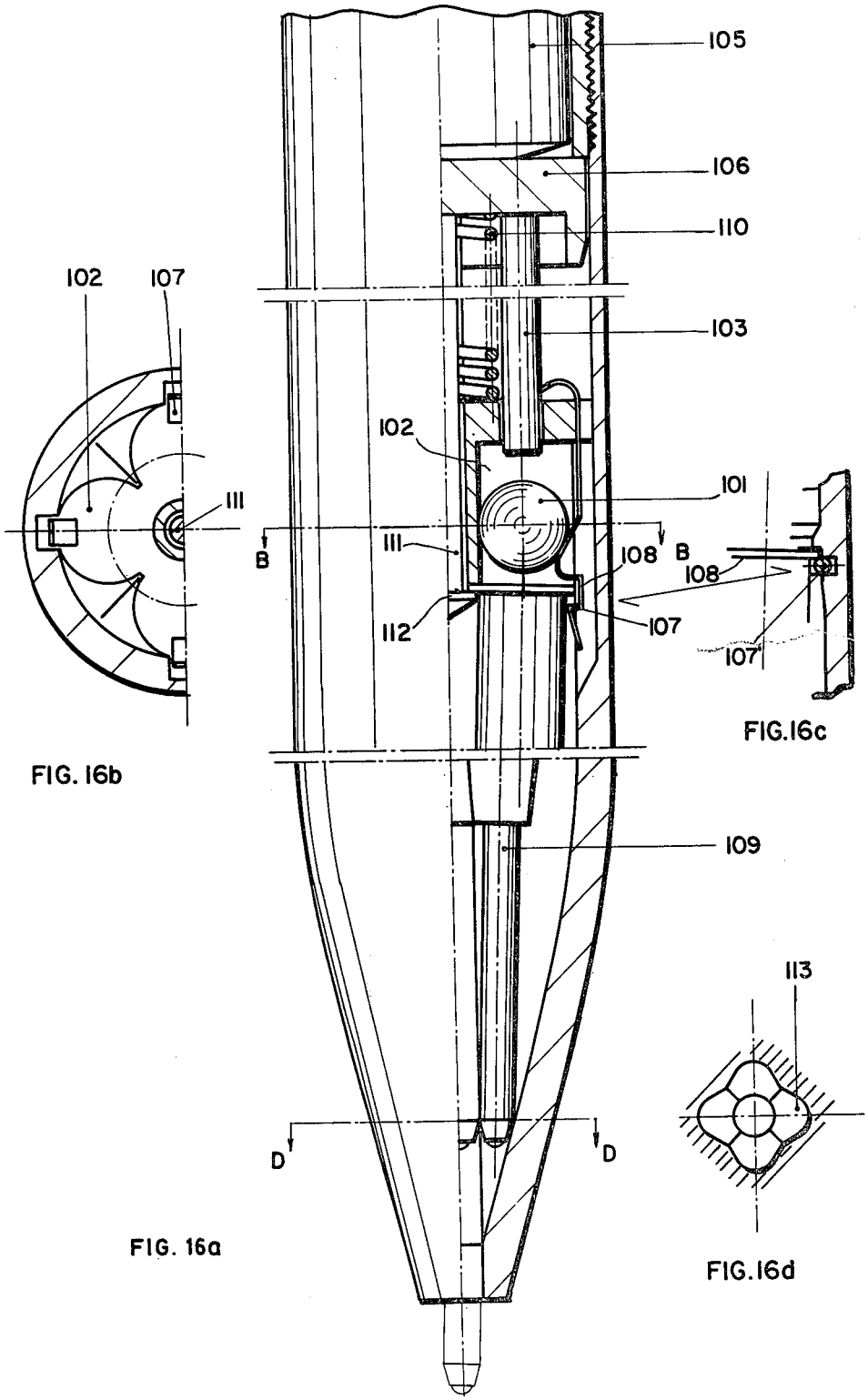

FIG. 16*a* is a cut-away view partially in cross-section showing an embodiment of an inertia pen pole, whose mechanism includes an accessory centered point selector.

FIG. 16*b* is a partial cross-section along line B—B of FIG. 16*a*.

FIG. 16*c* is an enlarged detail view of a spring ring retainer.

FIG. 16*d* is a partial cross-section along line D—D of FIG. 16*a* without the pen points.

FIGS. 17*a* and 17*b* and 18*a* and 18*b* show cut-away partial sectional views of the pen of FIG. 16, but with eccentric point. FIGS. 17*b* and 18*b* taken along lines B—B respectively.

Figure 19B:
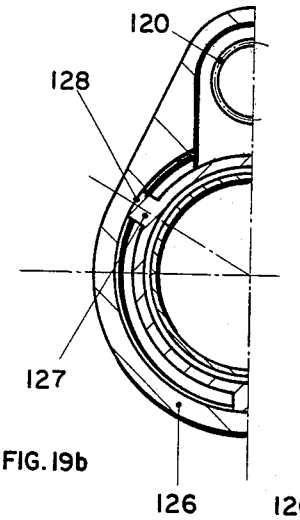
Figure 19C:
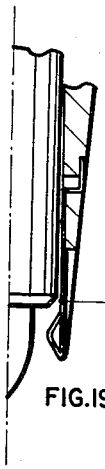
Figure 19A:
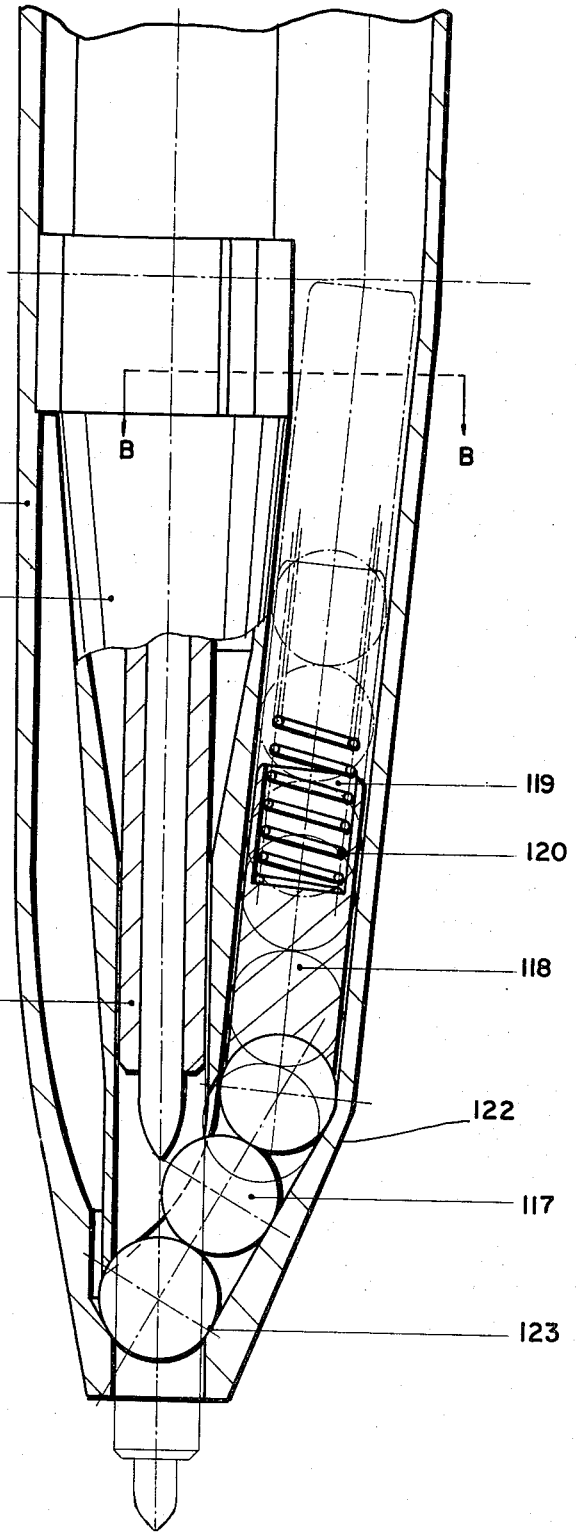

FIG. 19*a* shows in cross-section a ball obturator for markers or fountain pens having felt or nylon points.

FIG. 19*b* shows a partial cross-section along line B—B of FIG. 19*a*.

FIG. 19*c* shows an enlarged detail of the point retaining spring.

FIGS. 20*a, b, c,* and *d* are cut-away, partially cross-sectional and detail views showing a conic obturator, in which one can see the sealing flexible sleeve.

Figures 21A, 21B, 21C, 21D, 21E, 21F:
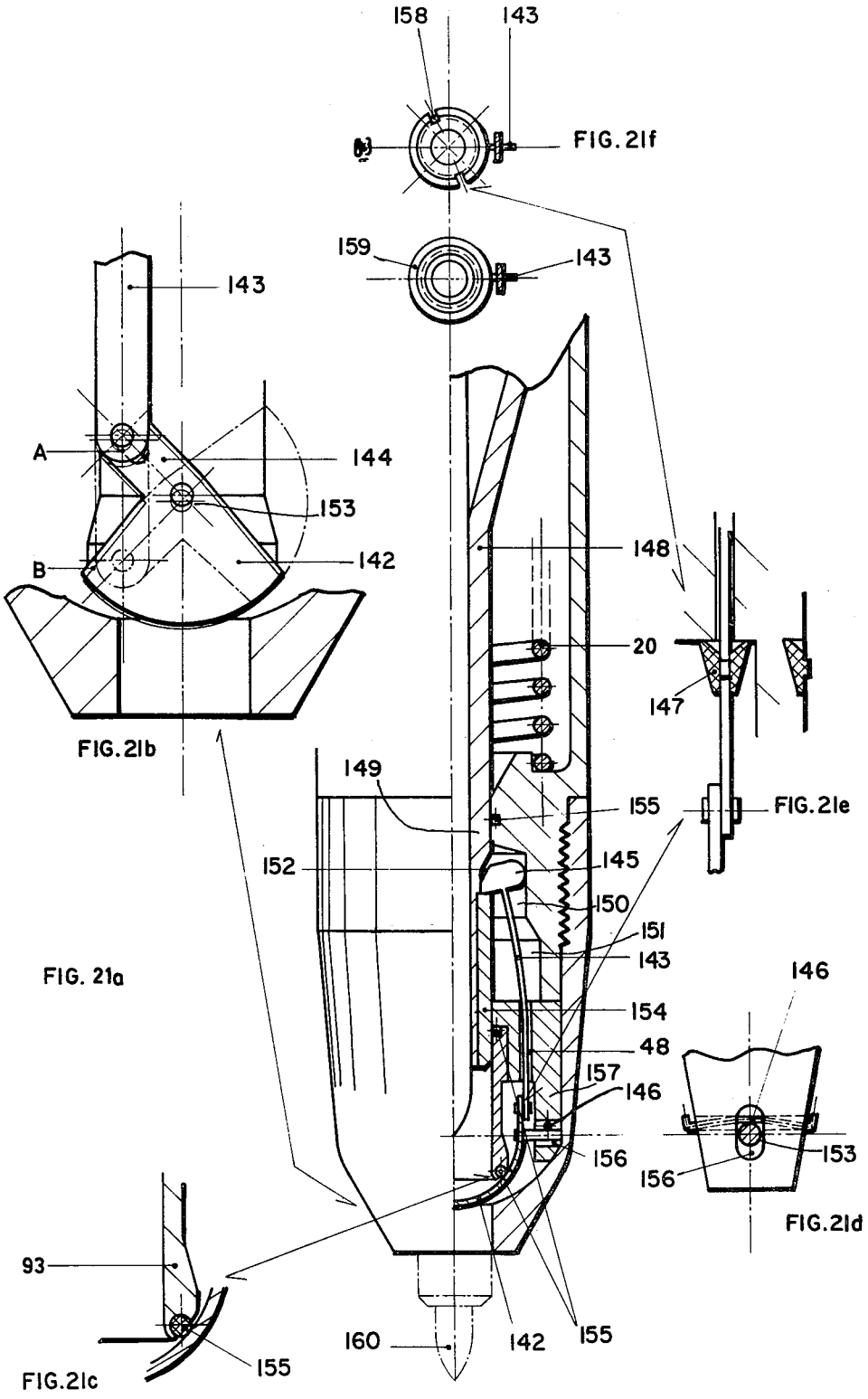

FIGS. 21*a, b, c, d, e* and *f* are cut-away, partially cross-sectional and exploded views showing a hemispheric obturator.

Figures 22A, 22B, 22C, 22D, 22E:
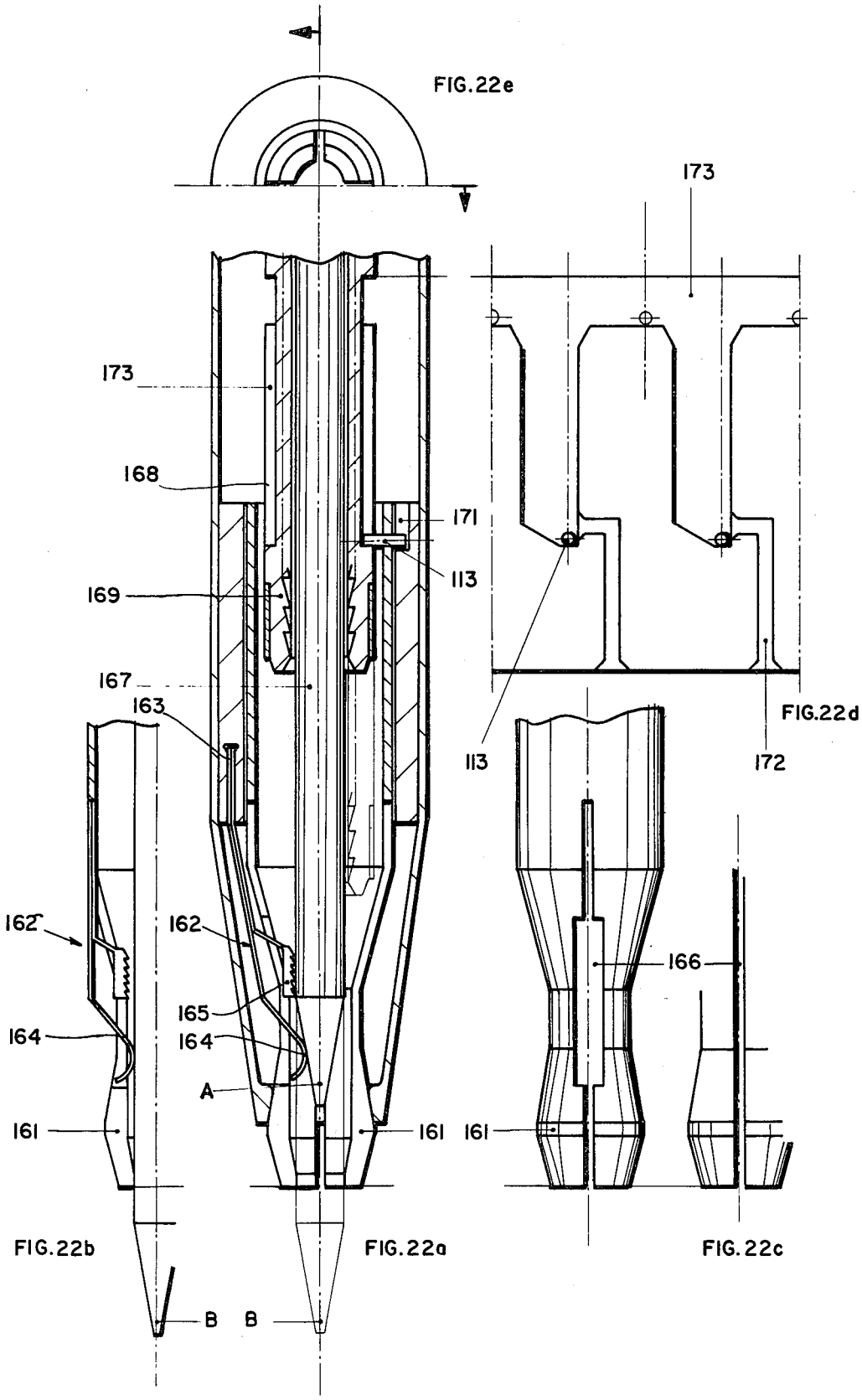

FIGS. 22*a, b, c, d,* and *e* are cross-section, detailed and schematic views showing an inertia pencil with gauge and moving collet.

Figures 23A, 23B, 23C, 23D, 23E:
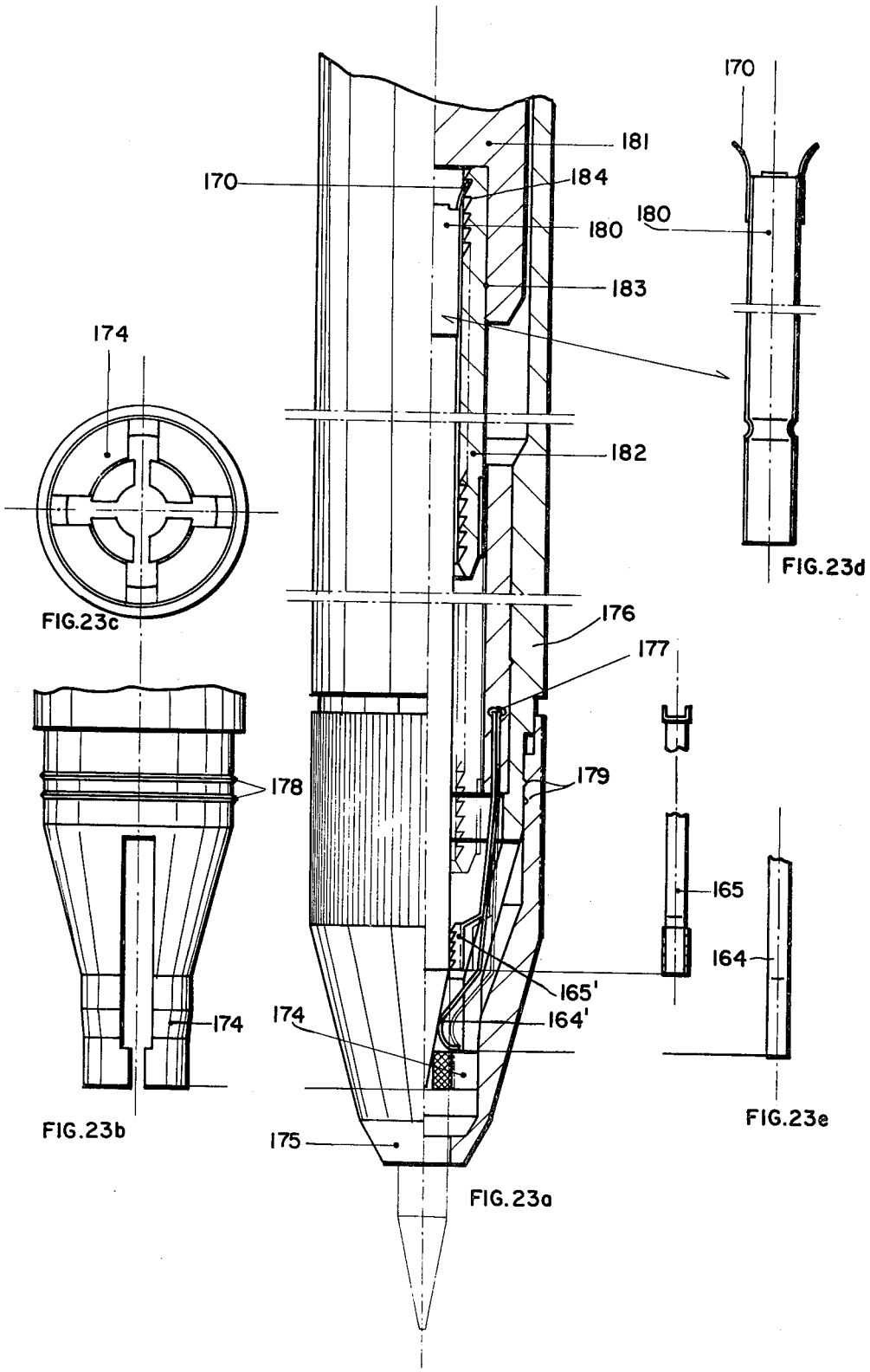

FIGS. 23*a, b, c, d* and *e* are cut-away, partly cross-sectional and separate detail views of an inertia pencil with gauge and casque with integrated fixed collet.

Figures 24A, 24B, 24C, 24D, 24E:
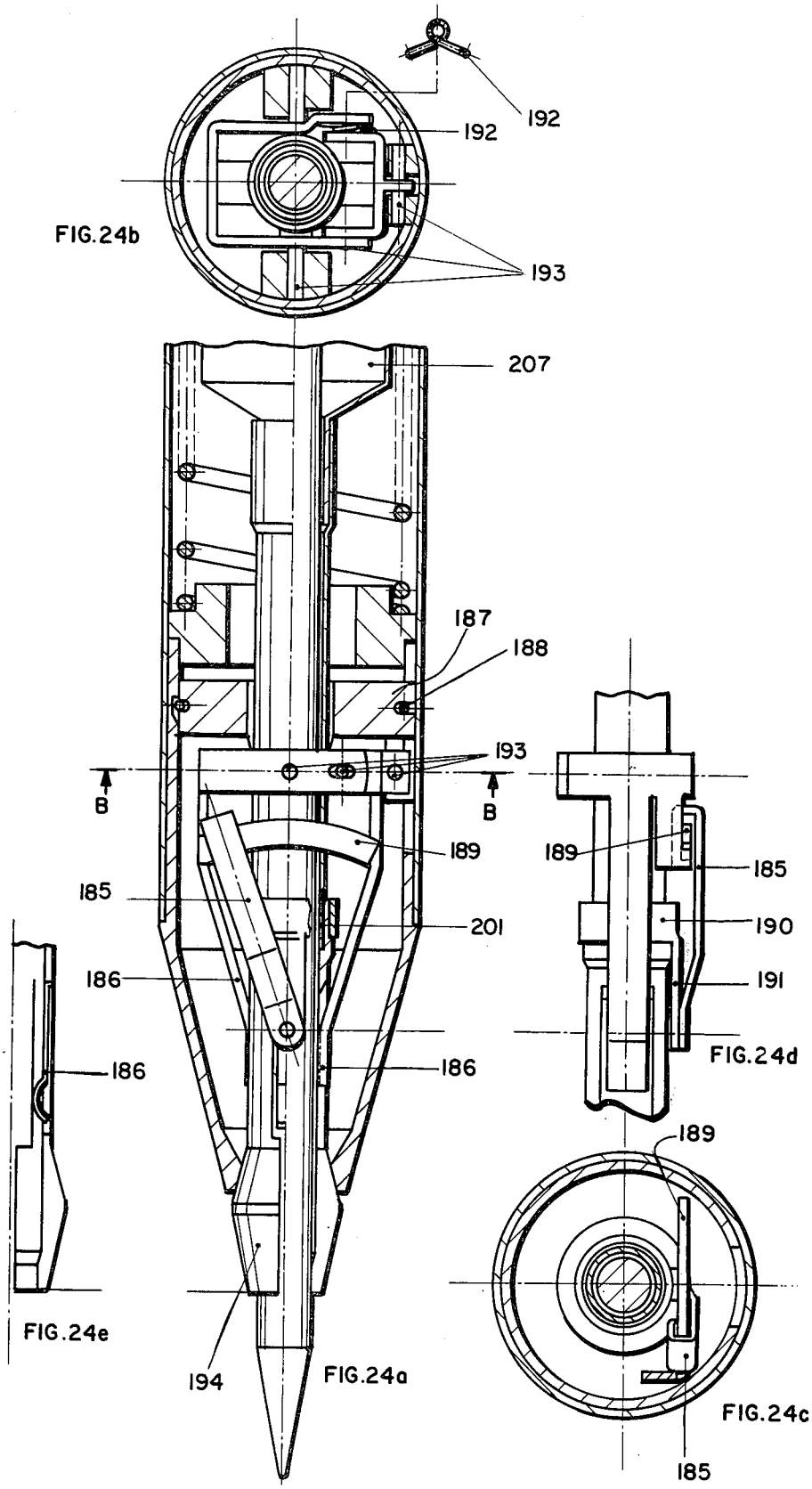

FIGS. 24*a, b, c, d* and *e* are cross-sectional and separate detail views of a telescopic inertia pencil, with gravity arm oscillator.

Figures 25A, 25B, 25C, 25D:
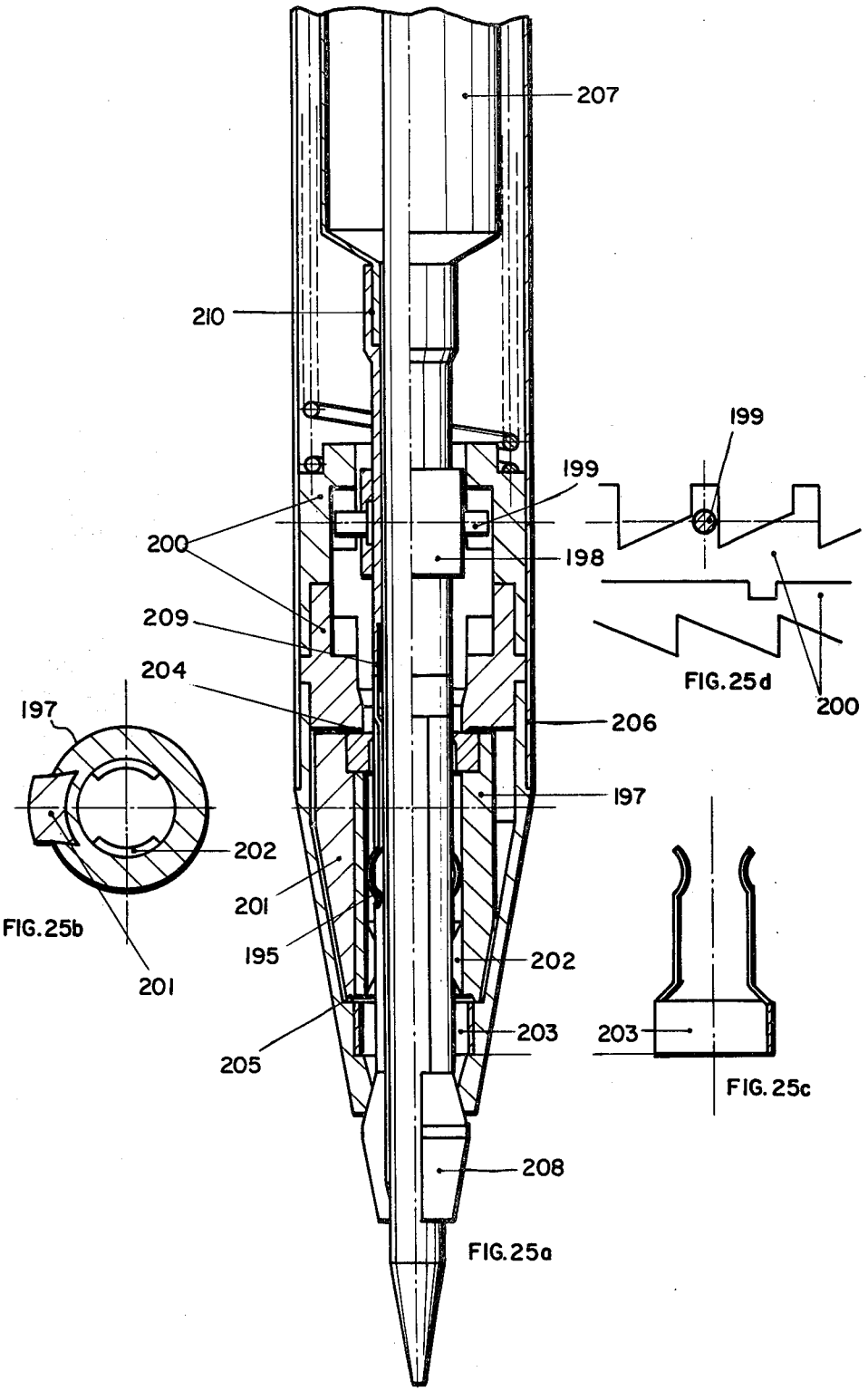

FIGS. 25*a, b, c* and *d* are cross-sectional and separate detail views of a telescopic inertia pencil, with gravity eccentric mass drum oscillator.

Figures 26A, 26B, 26C, 26D, 26E, 26F:
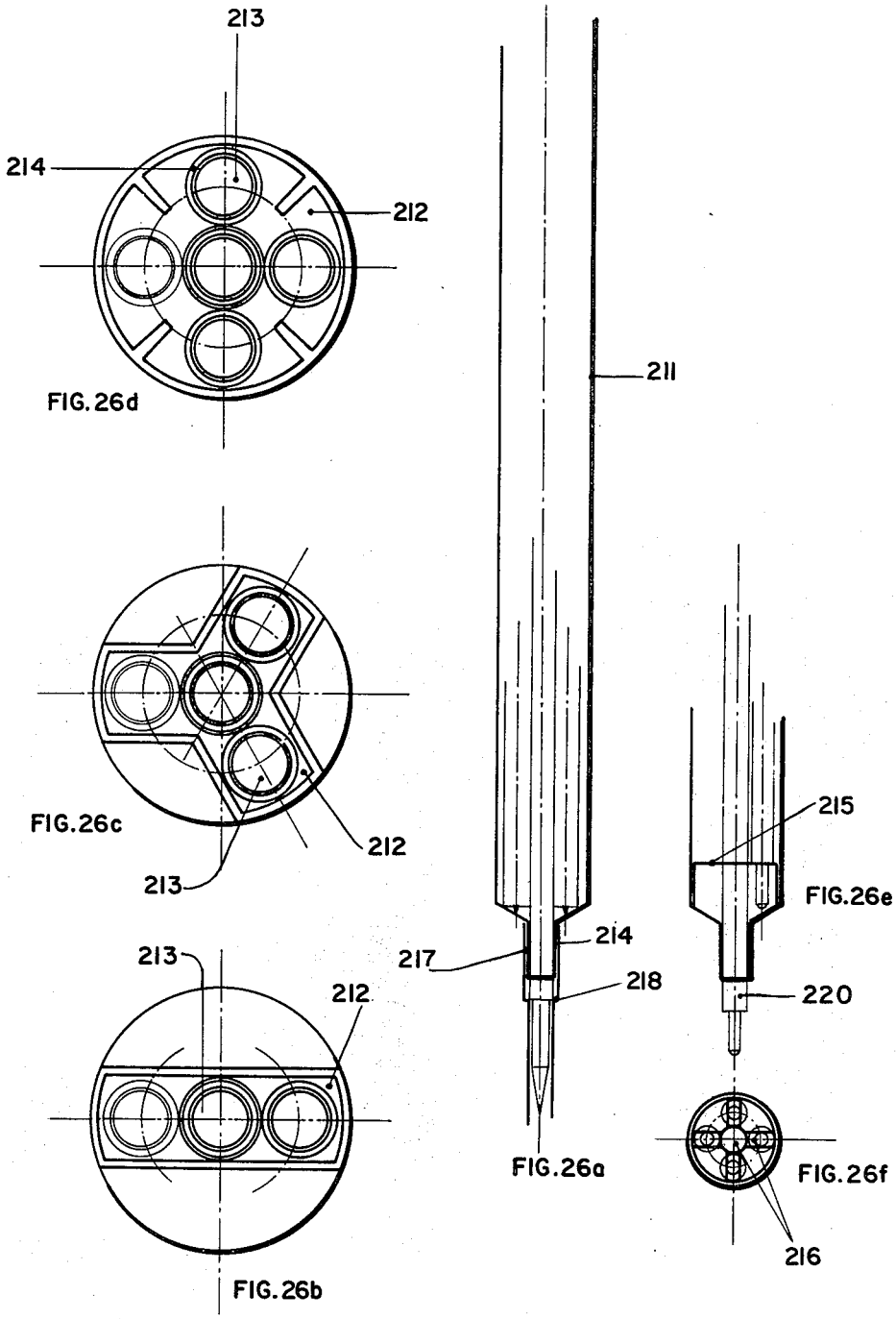

FIGS. 26*a, b, c, d, e* and *f* are several views partly schematic of point selecting depots which select one of two to four points, by oscillation, rotation and gravity.

Figure 27B:
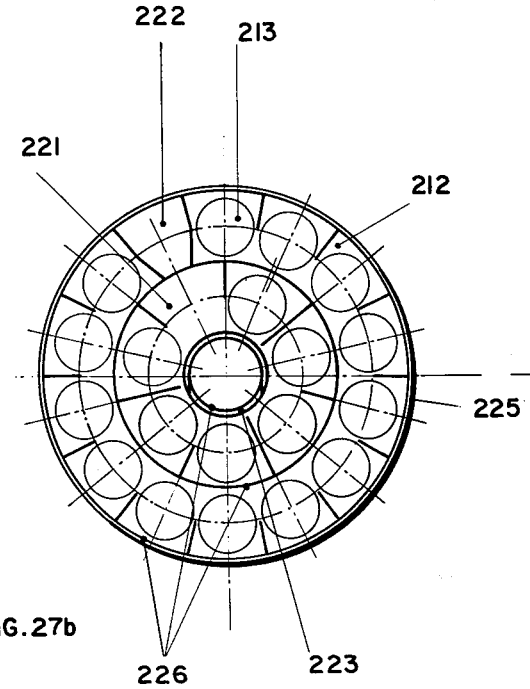
Figure 27A:
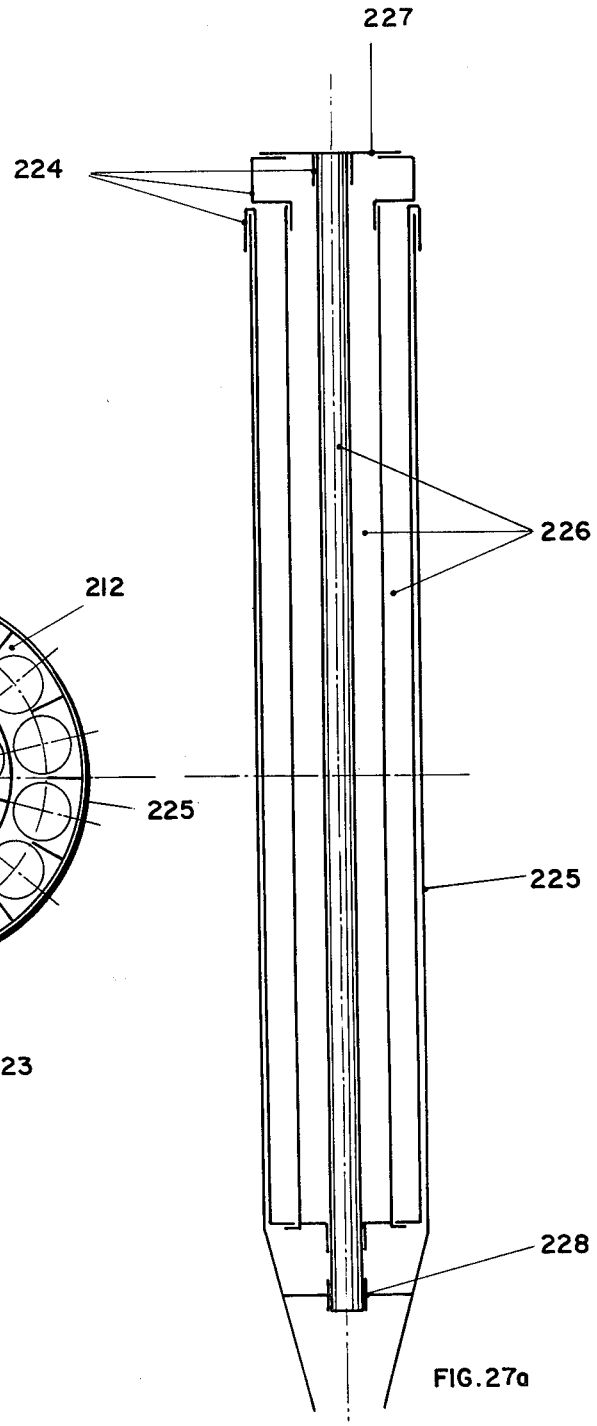

FIGS. 27*a* and *b* schematically show a point selecting depot including a rotation button, which selects from more than four points, pencil leads, ball-points, or other types.

DETAILED DESCRIPTION

The design of my inertia pen and respective assemblies takes into consideration various requisites for writing instruments, such as manufacturing, assembling and working, as well as relative cost, utility, convenience and comfort. The following description will assist in understanding the invention and the manufacture of inertia pens, the numbers referred to corresponding generally to the numbers on the drawings.

The inertia pen of my invention includes various principles, components, assemblies, mechanisms, configurations and operating procedures, all of them innovative ones, which are described in detail as follows. Everything that is said about bipolar embodiments is naturally applicable to monopolar configurations. In accordance with the same principles and means covered by the preferred embodiments here presented, one may realize many others.

The guiding system is not described in detail, because it does not differ essentially from those in the public domain. Notwithstanding this, however, FIG. 7 and the schematic drawings of FIGS. 11 and 12 show its form and movements.

Figure 1:
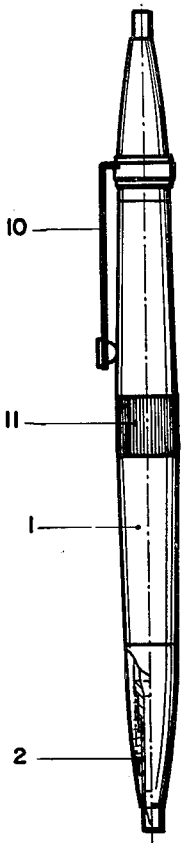
FIG. 1 is a view in elevation of a complete inertia pen, of the bipolar and sliding sleeve type of configuration, in which the body of the fixed refills, axially coupled, is also the main body of the pen, the points are fixed and each pole has an independent binary inertia mechanism.
Figure 3:
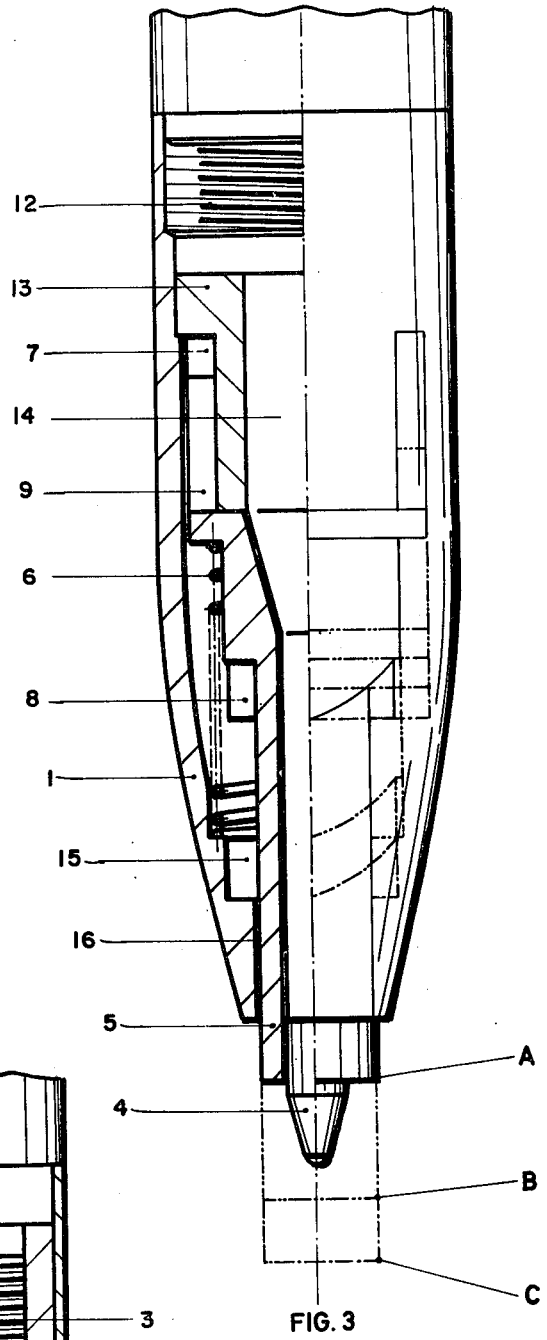
FIG. 3 is a cut-away view of one end of the pen of FIG. 1, the broken lines showing how it works.
Figure 2:
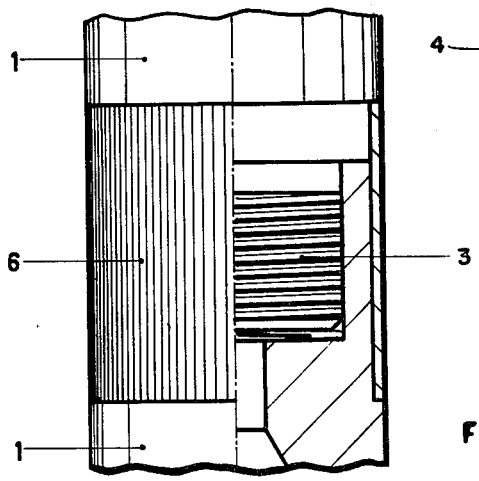
FIG. 2 is a partial cross-sectional view of a section of the pen of FIG. 1 showing a detail concerning the coupling of the fixed refills and points.

One of the preferred embodiments is the bipolar sliding sleeve inertia pen, shown in FIGS. 1 to 3, in which each polar body 1 is provided with a binary inertia mechanism 2. The polar refill bodies are coupled to one another by means of a screw connector 3 and constitute the principle bodies 1 of the pens or are rigidly attached with them. The refill points 4 are fixed.

The binary (alternating) inertia mechanism, which is characteristic to the inertia pen, essentially comprises a mass calibrated slide (sleeve or point) 5, a helical recovering spring 6 of calibrated force and a guiding system 7 to 9 disposed internally in the pen polar body 1 and slide 5.

The pen also includes pocket clip 10, a coupling sleeve 11, a polar joint 12, an additional reservoir or refill part 13, a tubular point column 14, guiding slopes 15 of the pen polar body 1 and the polar body cavity 16.

The operation of the mechanism, by the subjacent inertia principle, consists of an axial impulse, produced by an energetic and sudden flicking or whip action which transmits to the mass calibrated slide (sleeve) 5 the kinetic energy to be stored by the force calibrated recovering spring 6, so that it may ensure subsequent slide return. This energy is equivalent to that transmitted by a push button of a conventional pen. The guiding system is responsible for the necessary linear and rotating movements. With reference to FIGS. 3 and 4, letters A, C,B refer in that order to the positions successively occupied by the slide 5 during its movement and denote respectively its retracted position, fully extended position and partly extended position. Sequence BCA corresponds to the writing cycle where the point is uncovered and ACB corresponds to the storing cycle where the point is covered.

In calibrating the slide mass and recovering spring force, maximum and minimum, two factors must generally be taken into consideration: maximum axial (vertical) speed developed by the pen carrier, which is a function of gravity acceleration and carrier's jump height, and minimum axial speed sufficient to destroy the sealing effect of the obturator, for instance, as later described.

FIGS. 4 to 7 show an inertia pen embodiment of the bipolar sliding point configuration. The sleeve slide is replaced by a refill point 17 on the end of refill body 18. In other respects this embodiment is similar to the previous embodiment of FIGS. 1 to 3. The slide includes the writing point 17, the point column 19, the refill 20, the additional refill part 21, with turning slopes 22, spring cavity 23 and spring rest 24 for the polar return spring 25. Pen body 26 and its additional parts 27 provide the required turning slopes 28, spring rest 29 and spring hole 30. Letters A,B,C show respectively the retracted, partly extended and fully extended positions of the point, B being the writing position. Moreover, the guiding system of FIG. 7, is not particularly different fron that of conventional push button pens.

FIGS. 5 to 9 show various types of a point buffer applied to an inertia mechanism, either directly to it or to the refill body, comprising a buffering spring which may be helical 31 (FIG. 5), or conical 32 (FIG. 7), or laminar 33 (FIG. 6), duly calibrated, a mounting pin 34, and a refill body 35, a guiding system, and mounting hooks 37 which are biased to engage in the refill cavities 47. A buffered point permits a lighter and less marked handwriting.

FIG. 5 shows a pen body 26, pen body fixed additional parts 39 and 40, with convenient guides for a slide buffer, comprising the guiding system rear body 35, with dents 41 and dent slopes 42, the buffer cylinder spring 31, and the mounting pin 34, and a refill body 18 with reduced neck 44 and straight window 45.

FIGS. *6a* and *6b* show a writing point buffer provided with laminar spring 33. The guiding system rear body 40 is different and comprises mounting and sliding hooks 37. The refill additional part 46 is also different, comprising grooves 47 and bevel 48 for hooks 37.

FIGS. *7a, 7b, 7c* and *7d* show an embodiment using a conical spring 32, buffer and shows various details of the guiding system. The pen body part 49 with internal ribs 50, and the buffer moving body 51, with grooves 52 prevent buffer body rotation, and the rest ring limits linear sliding movement of buffer body 51. Slide dents and ventilating holes 53 may also be seen in the drawings. Fixed system guides 54 at bottom view show slope B and cavities A, which correspond to position A and B referred to above and shown in FIG. 4.

FIG. 8 shows an inertia binary mechanism with a bipolar recovering spring 55 replacing the two polar return springs 25, and with a buffer spring 56 common to both poles. The recovering spring is attached at its ends to the polar sliding rods 57 by fixing the ends in holes 58 of the rods. Holes 59 are provided for replacing refills. Buffer body 60, rest rings 61 and binary system dents 62 are also shown.

FIG. 9 shows in detail a way of installing a buffer-refill, provided with a buffer, conical spring 63 and a laminar coupling spring 64, into the slide ball head 65, at its neck 66. As a matter of fact, the slide 67 is stopped by the hole 59 so that the refill may be pressed into position. To extract the refill, it is merely necessary to reverse the process to withdraw the buffer-refill.

The bipolar recovering spring may be a compression type 68, as per FIG. 10, but in this case a rest disk 69 becomes necessary. In both embodiments, however, one of the sliding rods 57 is coupled to a tubular body 70 such as by of a pin or key 71, which encloses the spring, and the other sliding rod extends through a hole 72 in the opposite end of the tubular body and through the spring 68 and is provided with a flange 73 at its end which engages the end of the spring.

The sliding refills (FIG. 11) may be coupled axially and directly, in which case the inertia bipolar mechanism may occupy the internal space 74 of the pen body. The drawing shows that every tooth 75 of the guiding system 76 is common to both poles and pertains to a drum 77 rigidly connected to the coupled refills. Reference 230 denotes fitting joints. In this configuration the inertia pen exposes only one point at a time or hides both. The inertia pen may also comprises a guiding system with a convenient profile in order to have more than two levels, i.e., more than one elongation position for the exposed point, as shown in FIG. 12. Letter A corresponds to the retracted position, $B_1$ and $B_2$ to different writing positions, and C to maximum or fully extended position. This iterative inertia telescopic pen permits special applications, such as for stencils.

FIG. 13 shows the feasibility of providing the bipolar inertia pen with a conventional push button, without affecting its inertia bipolarity. The cylinder column 78 ensures connection between a push button 79 and opposite polar slide 80. Slots or windows 81 of the column 78 correspond to protuberances on the removable part 82, internal to the pen polar body. Groove 83 is a detent type connector between the telescoping parts. Polar points may be exposed or retracted simultaneously. However, the pen must be operated in such a way that the inertia point on the button pole is exposed after the other point, and that the push button be used when the inertia point is retracted.

This operating procedure differs from the normal one, i.e., in which polar points may be exposed or hidden simultaneously, if necessary. FIG. 13 also shows other components previously described, such as spring rest 84, sliding point 85, return spring 86, polar fixed slopes 87, polar slide slopes 88, rear dents 89, and slopes 90.

FIG. 14 shows a thin multiple point 91, for which a special binary inertia mechanism is not required.

FIG. 15 shows an inertia pen comprising a multiple point 92 exceeding the carrying tube diameter 93 and normal guiding polar hole diameter. The sliding refill is not free to rotate during its course, due to guides 94 and 95 which receive wings 96. The main slide 97 turns in contact with column 98 of non-rotating refill slide 99. Recovering spring 100 is also of greater diameter.

FIGS. 16 to 18 show an inertia pen provided with a sphere gravity selecting mechanism. When the pen is turned on its axis, the sphere 101 always occupies the lower receptacle 102, thus preventing the impulsion rod 103 from entering respective empty refill 104. Then, the turning slide 105 pushes forward, by inertia, the non-rotating sliding piece 106 and respective impulse rods 103, which penetrate the free refills and push forward the refill engaged by the sphere. Therefore, the sphere frees the refill, by pressing the spring hook 107 radially outwardly to disengage it from the flange 108 on the upper end of the refill 109. Due to recovering spring 110, the axial traction column 111 which has a flange 112 on its lower end engaging the radially inner part of the flange 108 on the refill travels with the refill and returns the refill back to the retracted position when desired. Guides 113 help the longitudinal positioning of points and respective refills.

The polar recovering springs may be a single bipolar spring 110, or a plurality of springs 114 as shown in FIG. 18*a* with the corresponding modifications in the binary inertia bipolar mechanism. The hook spring 107 may be a simple ring spring 107' as shown in FIG. 16*c* or a four hook spring ring as shown in FIG. 16*b*.

Also, as shown in FIGS. 17–18, the selector may comprise eccentric points 115 and eccentric polar springs 116, instead of hook spring 107 and traction column 111.

The eccentricity may be compensated by means of oblique points and springs resting disk (not shown) with convenient holes, or by guiding grooves.

FIGS. 19 to 21 show a sealing device for an inertia pen, comprising a sealing closure for markers, felt or nylon tips or fountain pens which obviates traditional caps. The drawings show three different embodiments: sphere sealing pen, conical sealing pen and hemispherical calotte sealing pen.

The sphere obturator comprises three spheres 117, one for sealing and two for transmission, a concave top piston 118, with receptacle 119 for the positioning helicoidal spring 120, a laminar retaining spring 121, the eccentric housing 122, the sealing hole 123, a removable part of the polar body 124 and felt points tubular stems 125 or other markers. When the pen is whipped or flicked forward and downward, spring 120 is compressed by the spheres, due to resting inertia. By stopping and/or inverting the pen movement, point 125 passes retaining spring 121 by slipping past the sloping end and blocking the spheres. The sealing device operates when the point is retracted for then the spring 120 urges the spheres unobstructed by the point towards the tip until the outer sphere seats in sealing hole 123 also shown are the pen body 126, and additional part 127 with screw 128.

The conical obturator of FIG. 20 comprises two semiconical jaws 129, an elastic sealing sleeve 130, fixed to the jaws by piece 131, a cup-shaped spring retainer 132 for retaining the position spring 133 at the jaw and pivots 134 for pivotally mounting the jaws within the housing, mounting hole 135, and semiconical jaw re-entrant cams 136.

When tubular point stem 137 runs forward, it opens the jaws, because of the angular shape of its stem which engages the re-entrant cams 136. The felt tip 138 does not touch these cams. When it is retracted the jaws close in consequence of spring 133 action due to this spring being compressed between retainer 132 and additional part 139 which is coupled by screws 140 to polar body 141. The flexible sleeve 130 ensures perfect sealing.

The embodiment using a hemispherical calotte 142 obturator is more delicate. It comprises a hemispherical calotte pivotally connected by pin 153 to the body part 157, a connecting rod crankhandle system 143 and 144, a sloped hammer 145, on the upper end of the connecting rod, a straight iron spring 146, and sealing members 147. When point stem 148 slides forward, it pushes the connecting rod 143 and hammer 145 via the enlarged section 149 on the stem 148 through bore 150 until it reaches the enlarged bore 151 in the pen internal body, where the stem 148 then slips past the beveled face 152 on hammer 145 and the connecting rod 143 has moved the calotte about its pivot 153 axis to the open position. The connecting rod is a laminar spring which presses the hammer lightly against the sliding stem so that when the stem retracts, the shoulder on the upper end of sleeve 154 engages the inner lower shoulder on the hammer and thereby retracts the hammer and connecting rod returning the calette about its pivot axis to the closed position. Elasting rings 155 optimize and complement the sealing. The straight iron spring 146 releases the calotte before it starts closing, because the pivot pin 153 is then in the lower end of pivot slot 156 and engages the pin only in the closed position. Due to the way the connecting rod works, necessary tolerances must be taken into consideration in its manufacture, as regards slot 156 and the pivot axis. Letters A and B (FIG. 21*b*) show the connecting rod respectively at the retracted (sealing) position and the forward (open) position respectively. Channels 158 allow the hammers to pass when a refill enters the pen. Instead of the channels, a removable tube 159 may be used. The writing point 160 itself does not touch the calotte.

The inclusion of the obturator accessory into the inertia pen embodiments results in an enormous reduction in comsumption of ink especially rapid drying inks. It is very simple and practical in its operation, this being essential so that one may easily retract the marking tip every time it is not being used.

FIGS. 22 to 25 illustrate embodiments of a calibrating mechanical pencil inertia pen and a telescopic mechanical pencil inertia pen.

In FIG. 22, a collet 161 is provided in the alternating inertia mechanism, and the calibrator 162 either is integral with the collet stem 163 or with the pen body. It includes a spring feeler 164 and a calibrating collet 165, which pass through large slots 166 provided in the pen collet 161. FIG. 22*a* shows the calibrator with the lead 167 and slide 168 in position A, where is retained in the retracted position the lead with the slide returned backwards. FIGS. 22*a* and 22*b* show position B of the slide and lead where the spring feeler slightly touches the lead and the calibrating collet does not. When the graphite or other lead is shortened by use, it is only necessary to withdraw it by inertia impulse and expose it again automatically calibrated, also by inertia.

The lead stand 169 comprises two hollow semicylinders, each one having an internal feed rack for ratchet 170 as shown in the embodiment of FIG. 23, and a longitudinal channel, parallel to it, for manual adjustment of the ratchet position of the rack, and with external supplementary guides 171. Guides 172 are required to mount the mechanism. This embodiment of the inertia pen is multifunctional: alternating, embracing, calibrating. When the slide and lead stand go forward, due to a sudden impulse, collet 161 frees the lead which runs with them because the ratchets stay on the rack position. On its movement backwards, by cooperative action of the recovering spring, the main guide system (not visible) and the supplementary guides 173, the lead is blocked by the collet at position B.

Lead adjustment may also be manual, i.e., without calibrator. If so, ratchets may be replaced by rigid pieces. It is convenient to include one more level into the guiding system to facilitate operation.

FIG. 23 shows a second embodiment of calibrating pencil inertia pens. This one of FIG. 23 differs from the previous one because its collet 174 does not move with the slide but is actuated manually by a casque 175. The drawings show that the calibrator is fixed to the pen body, since the piece 176 in which its upper end 177 is embedded is manufactured by injected molding and is also fixed to that body. The ribs 178 correspond to casque position grooves 179. Socket 180 is described below. As for the main inertia mechanism, only the slide 181 is visible with the lead stand 182 fixed to it by a press fit into bore 183. Also shown are ratchet 170, feed rack 184, and calibrator with its gauge 165' and feeler 164'.

FIG. 24 shows an embodiment of a telescope mechanical pencil inertia pen, comprising two main assemblies, namely the collet (pencil) alternator and the gravity telescopic elongator. The inertia alternator differs from usual mechanical pencils because the external surface of the collet and the corresponding resting cone have a steeper angle and there is no need for the push button.

The elongator or lead length regulator ensures controlled action in both senses and is applied to a binary inertia mechanism, comprising a gravity oscillator having two oscillating arms 185, a carrying collet 186 with two articulated arms, a piston 187 and ring 188, a curved lam 189, a tubular ring 190 with advanced arm 191, arms straightening spring 192, pivots 193 and lead positioning collet 194. If the gravity oscillator is as shown in the drawing, when the slide runs forward, the carrying collet 186 is forced against the lead and this is carried with it. When the slide returns, the carrying collet opens leaving the lead held by the positioning collet 194. If gravity oscillator 185 is in the opposite position (180° to that shown in the drawing) the carrying collet 186 runs forward opened and runs back closed, carrying the lead with it. In this case, spring 192 ensures final straightness of the articulated arms together with ring spring 188 when it reaches the respective groove, and so ensures free movement of gravity arm 185.

FIG. 25 shows an embodiment of a telescopic mechanical pencil inertia pen in accordance with the previous configuration, but the carrying collet 195 is fixed to the pen collet, and the arms of the gravity oscillator are replaced by an eccentric mass drum 197.

The inertia alternating system is visible together with a schematic of the guiding system 198, 199 and 200. The telescopic assembly comprises the drum 197, with eccentric mass 201 and guide ways and slope internal wings 202, a positioning ring 203 with arm laminar springs, and a carrying collet 195, which occupies the slots allowed by the positioning collet.

Its operation is as follows: eccentric mass 201 has two opposite angular positions, and this is also true of the guide ways and slope wings 202, consequently, the carrying collet holds the lead during its travel forward and releases it backwards, and vice versa. Ribbings 204 and 205 reduce friction. A screw thread 206 joins the main and polar bodies. The reservoir 207 for replacing points is connected to the collet by a tubular column with joints 209 and 210.

Consumable points or leads may be sharpened normally, without damage for the inertia pen telescopic mechanism.

Finally, innovative points, depots and refills, as applied to the inertia pen, must be mentioned and described.

The oblique point 91 and 92 is included in FIGS. 14 and 15 and is referred to in the eccentric selector description of FIG. 17, although not included in these last drawings. It may be simple or multiple, and exceed may or may not the point stem diameter on which it is mounted.

Consumable points or leads may be provided with a socket 180, FIG. 23 having two opposite positions, including an optional ratchet base 183. When the lead is too short to be sharpened and used, it is removed from the long section of the socket and introduced into the shorter one, thus allowing an additional length corresponding to the length difference between the two sections.

The depot, refill or body supporting or containing the point may be provided with an accessory buffer, FIGS. 5 to 9, this permitting the point to have a smooth writing and a less marked line. The buffer spring must be duly calibrated, or be of appropriate strength.

Any point may be used in the inertia pen if its dimensions and mass are correctly calibrated and an appropriate socket is provided.

FIGS. 26 and 27 show embodiments of selecting depots, respectively for two to four gravity points, or for a greater number of points by means of a rotating button, gravity rotation and pen axis oscillation, including ball points, felt or nylon points, pencil leads and others.

FIGS. 26 and 27 also show multiple depots for multiple points (multiple points do not imply necessarily multiple depots), coupling depots for inertia selectors and simple longitudinally coupling depots, FIG. 11, or assembling ones, FIG. 17.

FIG. 26 shows schematically details of the selecting depot 211 comprising housing cells 212 for leads or points 213 contained in moving tubes 214. Table 215 has slots 216 to keep writing ball points 220 out of contact with the depot walls. The connection tube 217 of depot 211 has a double diameter in order to provide for a rest table or shoulder 218 for the moving tube 214, when the latter comes forward, thus preventing lead friction when it is present for telescoping action.

Operation of a telescopic inertia pencil, provided with a two to four points selecting depot, has the following procedure in five steps: pen axis oscillation backwards, pivoting on its median point; pen rotation about its axis to select the desired writing point; new oscillation, in the opposite sense, to present the chosen point; new pen rotation, to select telescopic pretended action (forwards in this case): successive axial impulses until desired point length is obtained.

This stepwise process would be reversed should one desire to take exposed point and depot backwards or to replace the point.

If the selecting depot is provided with a rotating button, as shown in FIG. 27, and not by mere gravity, that will not alter the selecting processes meaningfully. Nevertheless, one should notice that one of the cells 221 for the cylinder tubes 214 must be void, and one of the cells 222 of the external tube will be closed. Presentation on line of the selected point from among those available is ensured by the central cylinder, in which one can see a longitudinal feeding window 223, which must be kept in the lower rotation position during the selecting phase. FIG. 27*a* shows a schematic drawing of a rotation button 224 and pen body 225, as well as removable internal tubes 226, cover 227 and guide 228 which positions the central tube. It is evident that an external quadrant is required to give indications of the angular positions and this is true also of FIG. 26 inertia pen depots.

Preferred embodiments contained in the present drawings and description must be understood as mere examples of the numerous embodiments of the inertia pen of my invention, and not as an exhaustive specification of same. Therefore, many other embodiments are possible which would be within the scope of the claims following.

What is claimed is:

1. An inertia pen comprising a hollow tubular shaped housing having at least one reduced tapered end, a tubular marking element removably and coaxially mounted within said tubular housing and having a marking tip on one end extending through said tapered end of said tubular housing in spaced coaxial relationship therewith, and an inertia mechanism comprising a tubular mass-calibrated sleeve member slidably and coaxially mounted within said tubular housing between said housing and said marking element, said sleeve member having a tip shielding portion extending through said tapered end of said housing surrounding said marking tip of said marking element, said sleeve member being axially movable between an outer non-marking position wherein said shield portion completely encloses said marking tip and an inner marking position wherein said shield portion is retracted to expose said marking tip, a spring means within said tubular housing interposed between said housing and said sleeve member to resiliently urge said sleeve member into the retracted position, guide means for guiding said sleeve member between said marking and non-marking positions, and stop means to releasably retain said sleeve member in said non-marking position so that said sleeve member may be operated by an impulse on said housing to selectively be moved into said marking or non-marking position.

2. The inertia pen as claimed in claim 1 wherein a first shoulder is provided on the inner end of said sleeve member, a second shoulder is provided on the inner surface of said tubular housing, and said spring means is a helical coil spring engaging said shoulders at its ends so that it is compressed at least in said marking position.

3. An inertia pen according to claim 1 wherein said tubular housing has two tapered ends, a tubular marking element is provided at each of said ends, and an inertia mechanism is provided at each end so that said sleeve members may be moved into said marking or non-marking positions.

* * * * *